US005319334A

United States Patent [19]

Klerken

[11] Patent Number: 5,319,334

[45] Date of Patent: Jun. 7, 1994

[54] IMAGE FORMING DEVICE

[75] Inventor: Pierre A. M. Klerken, Venlo, Netherlands

[73] Assignee: Oce-Nederland B.V., Venlo, Netherlands

[21] Appl. No.: 71,270

[22] Filed: Jun. 4, 1993

[30] Foreign Application Priority Data

Jun. 4, 1992 [NL] Netherlands ..... 9200977

[51] Int. Cl.[5] ..... G03G 15/09

[52] U.S. Cl. ..... 355/251; 346/153.1; 346/160.1; 355/214; 355/246; 118/656

[58] Field of Search ..... 355/210, 214, 215, 251, 355/253, 246, 245, 296, 301, 305; 118/656–658, 661, 652; 346/153.1, 160.1

[56] References Cited

U.S. PATENT DOCUMENTS

| | | | |
|---|---|---|---|
| 3,145,122 | 8/1964 | Streich, Sr. | 118/658 |
| 3,572,288 | 3/1971 | Turner | 355/251 X |
| 3,946,402 | 3/1976 | Lunde . | |
| 4,062,321 | 12/1977 | Greenig . | |
| 4,354,454 | 10/1982 | Nishikawa . | |
| 4,461,238 | 7/1984 | Baier et al. | 118/658 |
| 4,466,728 | 8/1984 | Schlageter et al. | 118/658 X |
| 4,487,496 | 12/1984 | Baier et al. | 118/658 X |
| 4,704,621 | 11/1987 | Van Cooten et al. | 346/153.1 |
| 4,829,338 | 5/1989 | Whittaker et al. | 118/652 |
| 4,884,188 | 11/1989 | Berkhout et al. | 346/160.1 |
| 5,187,529 | 2/1993 | Nakayama | 355/296 |
| 5,247,317 | 9/1993 | Corver et al. | 346/160.1 |

FOREIGN PATENT DOCUMENTS

| | | |
|---|---|---|
| 0191521 | 3/1989 | European Pat. Off. . |
| 0304983 | 3/1989 | European Pat. Off. . |

OTHER PUBLICATIONS

European Search Report #9200977.

*Primary Examiner*—Matthew S. Smith

*Attorney, Agent, or Firm*—Birch, Stewart, Kolasch & Birch

[57] ABSTRACT

An image-forming device for recording images on a dielectric surface of an image-recording medium, in which the dielectric surface is in contact, in an image-forming zone, with developing powder bound to a powder support by a magnet system, the magnet system having two oppositely magnetized areas separated by a gap and, as considered in the direction of transport of the image-recording medium, disposed consecutively, the distance between at least one of the magnetized areas and the surface of the powder support being less than 150 μm and the distance between the same magnetized area and the surface of the image-recording medium being less than 600 μm, thus raising the background-free level while less magnetic material is required for the magnet system than in comparable devices.

4 Claims, 3 Drawing Sheets

PRIOR ART

IMAGE FORMING DEVICE

BACKGROUND OF THE INVENTION

1. Field of the Invention

The invention relates to an image-forming device, and more specifically to a device for recording images on an image-recording medium having a dielectric surface.

2. Description of Related Art

Image-forming devices of the nature herein under consideration are described, inter alia, in European patent applications 0 191 521 and 0 304 983. As explained in these patent applications, to achieve good image quality it is important that the developing powder mass, hereinafter referred to as the "toner brush," which, in the image-forming zone, is bound by magnetic attraction to a powder support acting as the powder transport means, should have a shape substantially remaining constant. A constant brush shape is important particularly on the side where the image-recording medium leaves the image-forming zone. A constant toner brush can be produced by a magnet system of the kind described in the above-mentioned European application 0 304 983. The construction of the magnet system described therein has the disadvantage that to enable use to be made of developing powder having a low percentage of magnetic pigment by volume, it is necessary to use very strong magnets in order to achieve an adequately strong magnetic field in the image-forming zone via the knife blade. The strong magnets required, which have to be used in duplicate, one on each side of the knife blade, make the magnet system expensive and bulky. In addition, the device has the disadvantage that if toner powder is used which contains only a little magnetic pigment, there is a fairly low background-free level. The term "background-free level" denotes the maximum voltage across the image-forming zone at which no toner deposition on the image-recording medium is observed. The disadvantage of a low background-free level is that, for example, as a result of a low tribo-electric charging effect between the toner brush and the dielectric surface of the image-recording medium, the finer toner particles from the toner brush are deposited on the image-recording medium, so that images are recorded with a background.

SUMMARY OF THE INVENTION

Therefore, it is an object of the present invention to provide a magnetic image-forming device which will overcome the above noted disadvantages.

It is a further object of the present invention to provide a magnetic image-forming device for forming images on an image-forming medium having a dielectric surface wherein the device is equipped with a simple and inexpensive magnet system.

A further object of the present invention is to provide an image-forming device for recording images on an image-forming medium having a dielectric surface, utilizing toner powder having a low percentage of magnetic pigment, having a higher background-free level.

The foregoing objects and others are accomplished in accordance with the present invention, generally speaking, by providing an image-forming device comprising an image-forming zone in which a dielectric surface is in contact with developing powder bound to a powder support by magnetic attraction of a magnet system cooperating with this powder support and in which a powder image is recorded on the dielectric surface by selectively applying an electric field across the image-forming zone in accordance with an image pattern. According to the invention, the magnet system comprises two magnetized areas separated by a gap and disposed consecutively in the direction in which the image-recording medium is transported through the image-forming zone, which areas have opposite magnetic poles at their ends terminating in the gap and which extend substantially parallel to one another over the entire working width of the image-forming zone, the distance between at least one of the magnetized areas and the surface of the powder support being less than 150 micrometers and the distance between the same magnetized area and the surface of the image-recording medium being less than 600 micrometers. Thus, according to the present invention a higher background-free level is achieved than in comparable devices as described above. A more compact and less expensive construction of the magnet system is provided which, for an optimum result to be realized in respect of a constant shape of the toner brush and maximum background-free level, may comprise much smaller magnets than are required in the prior-art devices to achieve an optimum result.

The result obtained according to the present invention is surprising, because it would be expected that a magnet system made up of a knife blade directed towards the image-forming zone and magnetized by strong magnets to saturation would generate a higher magnetic force in the image-forming zone than a magnet system constructed from two opposite magnetic poles separated by a gap, with which it would be expected that the magnetic field would extend primarily in the gap and have hardly any effect at a short distance above the gap.

According to a preferred embodiment of the invention, the width of the gap between the magnetized areas is from 0.5 to 20 times the distance between the magnetized area closest to the powder support and the surface of the image-recording medium. Preferably, the gap width is 1–2 times this distance, such that the most compact construction can be obtained for the magnet system with optimum image quality and maximum background-free level.

Preferably, the magnetized areas consist of a ferromagnetic material and are preferably magnetized by a magnetic connection to the north and south poles respectively of a permanent magnet. The form and magnetization of the magnetized areas are preferably such that their ends terminating in the gap are magnetically saturated.

Instead of a magnet system made up of a permanent magnet whose poles are connected to magnetizable elements terminating in the gap, equally good results can be obtained with a yoke of ferromagnetic material magnetized by energisation of a coil wound around the yoke. This electromagnetic embodiment, however, requires a fairly high current to achieve the same magnetization, and undesirable heat evolution may occur as a result. For this reason and because of the lower cost price, the embodiment with a permanent magnet is preferred.

BRIEF DESCRIPTION OF THE DRAWINGS

The invention is explained in detail below with reference to the following description and the accompanying drawings wherein.

DETAILED DISCUSSION OF THE INVENTION

Figure 1:
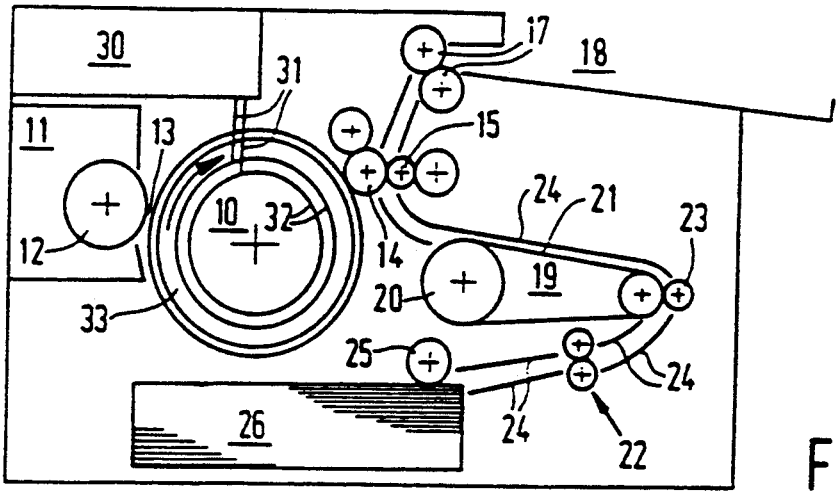
FIG. 1 is a diagram showing the principle of an image-forming device according to the present invention.

FIG. 1 is a diagram showing the principle of an electrostatic printing device having an image-forming medium in the form of a rotating drum 10 provided with an electrostatic layer made up of a number of controllable electrodes in and beneath a dielectric layer. The image-forming medium may, for example, be constructed as described in one of the European applications 0 191 521, 0 247 694 or 0 247 699.

In image-forming station 11 a magnetic roller 12 is disposed a short distance from the surface of the image-forming medium 10 and comprises a rotatable electrically conductive sleeve and an internal stationary magnet system. The rotatable sleeve of the magnetic roller 12 is covered with a uniform layer of electrically conductive and magnetically attractable toner powder which in an image-forming zone 13 is in contact with the image-forming medium 10. By applying a voltage between the magnetic roller 12 and one or more of the selectively controllable electrodes of the image- forming element 10, a powder image is formed on the image-forming medium 10. This powder image is transferred by pressure to a heated rubber-covered roller 14. From a stock pile 26 a sheet of paper is taken by roller 25 and fed via guideways 24 and rollers 22 and 23 to a heating station 19. The heating station 19 comprises a belt 21 trained about a heated roller 20. The sheet of paper is heated by contact with the belt 21. The sheet heated in this way is then fed through rollers 14 and 15, the softened powder image present on roller 14 being completely transferred onto the sheet of paper. The temperatures of the belt 21 and the roller 14 are so adjusted to one another that the image fuses on the sheet of paper. The sheet of paper provided with an image is fed via conveyor rollers 17 to a tray 18. Unit 30 comprises an electronic circuit which converts the optical information of an original into electrical signals which are fed, via leads 31 having slide contacts, and conductive tracks 32 in the insulating side wall of image-forming medium 10, to the controllable electrodes (not shown).

Figure 2:
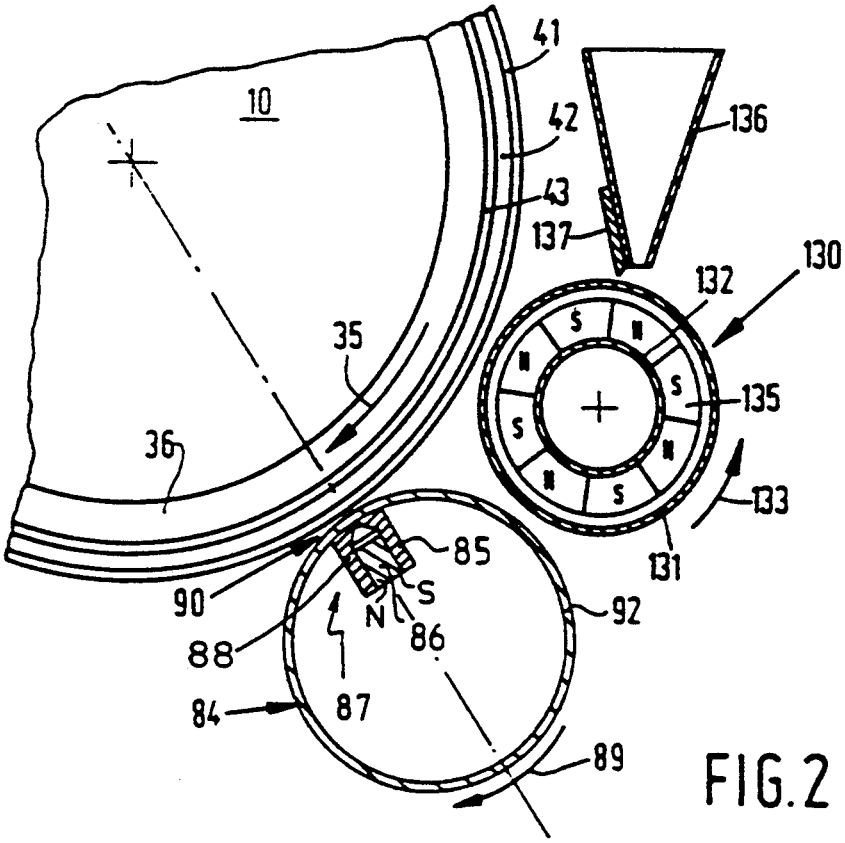
FIG. 2 is a magnified cross-section of a preferred embodiment of an image-forming zone according to the present invention.

FIG. 2 is a cross-section of an image-forming medium 10 in the form of a drum 36 rotatable in the direction of arrow 35 and provided with an insulating layer 43 on which there are disposed a large number of electrodes 42 which are disposed next to one another, insulated from one another, extending endlessly in the direction of movement of the drum, and are covered by a dielectric layer 41. Magnetic roller 84 comprises an earthed electrically conductive sleeve 92 rotatable in the direction of arrow 89 about a stationary magnet system 87. A uniform layer of conductive magnetic toner is applied to the dielectric layer 41 by means of a toner feed device. This feed takes place by means of a magnetic cylinder 130. The latter comprises a sleeve 131 of non-magnetizable material, e.g. aluminium, brass or stainless steel.

The sleeve 131 is mounted on a shaft 132 in a known manner so as to be rotatable and can be driven in the direction of arrow 133 by drive means (not shown). A number of magnets 135 are mounted on the shaft 132 of the magnetic cylinder 130, the shaft 132 being fixed in the frame of the printing device. Under the influence of the magnets 135 a magnetic field is produced at the surface of the sleeve 131. Magnetically attractable toner powder is applied from a reservoir 136 to the sleeve 131 of the magnetic cylinder 130 and retained thereon by the magnetic field. On rotation of the sleeve 131 in the direction of arrow 133, a layer of toner powder restricted to a specific layer thickness by a scraper 137, is conveyed to a transfer zone between the image-forming medium 10 and the magnetic cylinder 130. A uniform layer of toner powder is then transferred to the dielectric layer 41 under the influence of an electric field applied in a known manner across the transfer zone. The magnets 135 of the magnetic cylinder 130 must on the one hand satisfy the requirement that the magnetic induction should be high enough to generate a magnetic field at the surface of the sleeve 131, such that a layer of toner powder is retained and driven by the rotating sleeve 131 without causing dust problems. The magnetic induction is therefore determined by toner powder parameters and the speed of revolution of the magnetic cylinder 130. On the other hand, the magnetic induction of the magnets should not be too high in order that the layer of toner powder may be easily transferred in the transfer zone to the dielectric layer 41 without the need of applying a very strong electric field. These contradictory requirements can be met in two ways. First, by selecting an optimum magnetic induction for the transfer function for the magnet 135 which determines the field strength in the transfer zone, and an optimum magnetic induction in respect of the toner transport function for all the other magnets. Of course, a compromise can be selected in which the same magnetic induction forming a compromise for both functions is selected for all of the magnets 135.

A third function of the magnetic cylinder 130 is that toner powder remaining on the sleeve 92 of the magnetic roller 84 after passing the image-forming zone 90 is attracted by the magnetic field of the magnetic cylinder 130 and received in the toner powder layer on cylinder 130.

Figure 3:
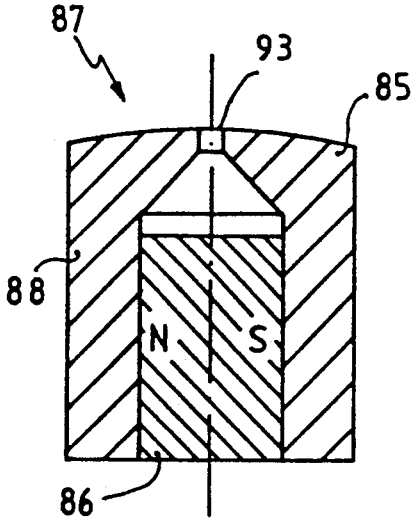
FIGS. 3 to 6 are sections of different embodiments of magnet systems for use in the image-forming device according to the present invention.

As described above, a layer of toner powder is transported to the image-forming zone 90 via the image-forming medium 10, and forms a narrow toner brush there under the influence of the magnetic field of the magnet system 87. The toner brush in the image-forming zone 90 is formed by the magnet system 87, which is shown to an enlarged scale in FIG. 3. The magnet system 87 comprises a permanent magnet 86 consisting, for example, of an alloy of neodynium—iron—boron or samarium—cobalt. Magnetizable elements 85 and 88 are fixed against the poles of the magnet, and their ends not connected to the magnet 86 terminate in a gap 93 and gradually narrow in the direction of gap 93. The magnet 86 and the magnetizable elements 85 and 88 are preferably so dimensioned that the ends of the elements 85 and 88 terminating in the gap 93 are magnetically saturated.

The magnetizable material of the elements 85 and 88 consists of ferromagnetic material. Preferably, a material having high saturation magnetization and high permeability is selected, such as iron—cobalt. Other suitable materials are iron and iron—nickel.

In the embodiment of FIG. 2, the magnet system 87 is so positioned in the sleeve 92 that the gap 93, which in this embodiment has a width of 300 micrometers, is situated in the center of the image-forming zone 90 and the inside of the sleeve 92 touches the magnetizable elements 85 and 88. There is no need for symmetrical positioning of the magnet system 87 with respect to the center of the image-forming zone 90. It has been found that to obtain good image quality, at least one of the magnetized areas 85 or 88 must be situated in the developing zone at a distance of no more than 150 micrometers from the surface of the sleeve 92. Also, the distance between the same magnetized area and the surface of the image-forming medium 10 should not be more than 600 micrometers, preferably about 200 micrometers. If larger distances are applied, then the attraction exerted by the magnet system 87 on the toner particles in the image-forming zone 90 is inadequate to take the toner powder (if no voltage is applied to the image-forming electrodes 42) completely from the image-forming medium, so that images with a background are obtained.

The width of the gap 93 between the magnetized areas 85 and 88 is preferably in the range from 1 to 2 times the shortest distance in the image-forming zone between the sleeve of the magnetic roller 92 and the surface of the image-forming medium 10. A wider gap, up to about 20× this distance, can be used, but a wider gap offers no advantages in respect of the image-forming result obtained and the size of the background-free level, and does have the effect that a larger stronger magnet must be used to achieve a sufficiently strong magnetic field at the ends of the magnetized areas.

COMPARATIVE EXAMPLE

Figure 7:
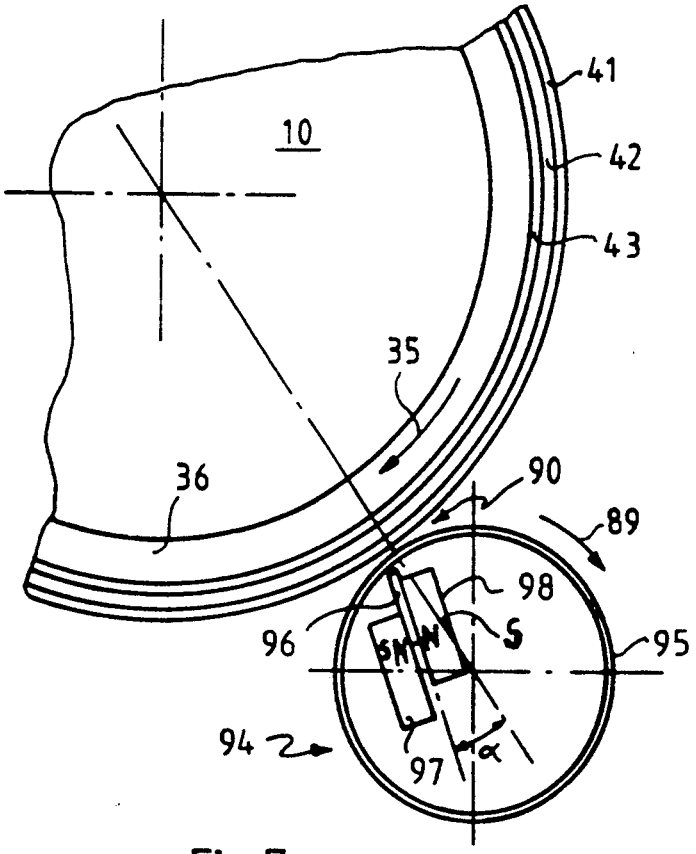
FIG. 7 is an image-forming section of a prior art device.

An arrangement as shown in FIG. 2, in which the magnet 86 consists of a bar magnet of neodynium—iron—boron having a magnetization of 1.1 T and a rectangular cross-section of 6×4 mm, elements 85 and 88 consist of iron, the gap 93 has a width of 300 micrometers, and the distance in the image-forming zone between the magnet 92 and the image-forming medium 10 is set to 200 micrometers, was compared with a device according to FIG. 2 of European patent application 0 304 983, which was set to give optimum image-forming results and background-free level. The image forming section of this prior art device is shown in FIG. 7. The device comprises an image forming medium 10 as described hereinbefore with reference to FIG. 2. In the developing zone 90 a developing device 94 is arranged which comprises a grounded sleeve 95 which is identical to sleeve 92 of FIG. 2 and is rotatable in the direction of arrow 89. The sleeve 95 rotates about a stationary magnetic assembly comprising a ferromagnetic knife blade 96 held between two magnets 97 and 98. The knife blade 96 consists of iron and has a thickness of 1.5 mm. Magnets 97 and 98 are in contact with knife blade 96 by like poles and are both composed of the same neodynium-iron-boron alloy as that used for the magnet 86 in the device according to the invention. The distance between the image-forming medium 10 and the sleeve 95 in the image-forming zone of the prior art device according to FIG. 7 was 200 micrometers. The magnetic assembly comprising knife blade 96 and magnets 97 and 98 was disposed at an angle $\alpha=15°$ with respect to the line connecting the centers of drum 36 and sleeve 95.

The developing powder was applied to the image-forming medium in the same way in both devices, to wit in the way as described hereinabove for the device according to the present invention.

The developing powder used in the comparison had the following composition:

thermoplastic polyester resin type Atlac 500T (ICI, England) derived from oxypropylated bisphenol A and fumaric acid, 1% by volume carbonyl iron with a particle size of approximately 2 micrometers (type HS, BASF, Germany), 3% by weight red dye (Basonyl Rot 560-C.I. Basic Violet 11:1) in the form of the perchlorate and had a specific resistance of 105 ohm.meter; obtained by coating the powder particles with fluorine-doped tin oxide in accordance with the process of European patent application 0 441 426, and a particle size of 10–20 micrometers.

Background-free images were formed in the device according to the present invention, the background-free level measured being ±5 volts. In the device according to European application 0 304 983 (FIG. 7), the optimum setting gave background-free images, but with a background-free level of ±2.5 volts. The knife angle (show in FIG. 7) at the optimum setting was 10 , while two magnets having a rectangular cross-section of 6×15 mm were necessary to achieve the optimum magnetic field. This means that the magnet volume is reduced by a factor of 7.5 in the device according to the invention. In addition, it was further found possible to form background-free images in the device according to the present invention with a measured background-free level of ±5 volts by using a bar magnet of a magnetic material of lesser strength, such as strontium ferrite or barium ferrite, with a rectangular cross-section of 6×15 mm. Although in this case the reduction of the magnet volume only has a factor of 2 with respect to the device according to European application 0 304 983 (FIG. 7), the materials for these permanent magnets are much less expensive than neodynium—iron—boron.

The rise in the background-free level as described herein-above using the device according to the present invention additionally offers the advantage that toner particles of a smaller particle size can be used, so that higher resolution can be achieved during image forming.

Figure 4:
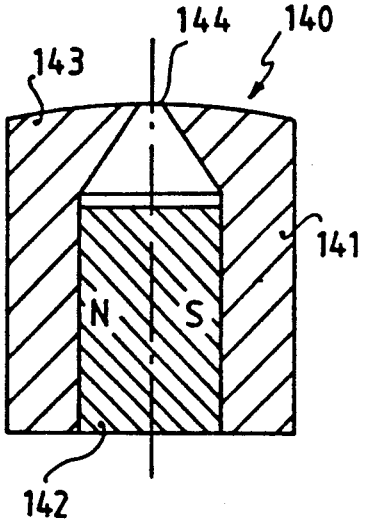
Figure 5:
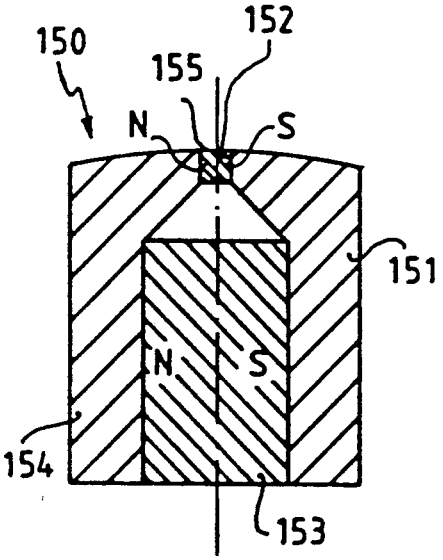
Figure 6:
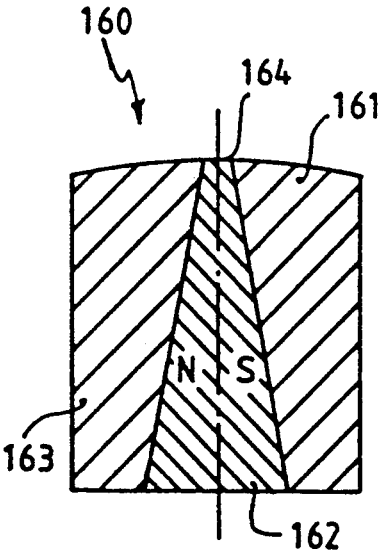

FIGS. 4, 5 and 6 show a number of alternate embodiments of magnet systems for use in the image-forming device according to the present invention. In all of the embodiments, permanent magnets 142, 152, 153, and 162 are used which, as far as materials and magnetic dimensions are concerned, correspond to the permanent magnet 86 in FIGS. 2 and 3. The magnetizable elements 141, 143, 151, 154, 161, and 163 used consist of the same materials as, and are similarly dimensioned to, the magnetizable elements 85 and 88. The magnet system 140 according to FIG. 4 differs from the magnet system 87 only in respect to geometry, in that the magnetizable elements 141 and 143 terminate at their ends and are not connected to the magnet 142 in the form of a point in the gap 144. In the magnet systems 150 and 160, as shown in FIGS. 5 and 6 respectively, there is an addition with respect to the magnet systems 87 and 140, in that permanent-magnetic material is present in the gaps 155 and 164 between the magnetizable elements 151, 154, 161, and 163, respectively. In the case of magnet system 150, this is accomplished by means of an extra permanent magnet 152 in the gap 155 between the magnetizable elements 151 and 154 while in the case of the magnet system 160 the space between the magnetizable elements 161 and 163, which space gradually narrows in the direction of the gap 164, is completely filled by the permanent magnet 162.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An image-forming device for recording images on an image-recording medium comprising in combination, an image recording medium having a dielectric surface, a powder support member with developing powder bound to a surface of said support by magnetic attraction, an image-forming zone between said image recording medium and said powder support member in which said dielectric surface is in contact with said developing powder, a magnet system juxtapositioned to said powder support member at said image-forming zone opposite said image-recording medium, and means for recording a powder image on said dielectric surface by selectively applying an electric field across said image-forming zone in accordance with an image pattern, said magnet system comprising two oppositely magnetized areas, separated by a gap, which are disposed consecutively in a direction in which said image-recording medium is transported, said magnetized areas extending substantially parallel to one another over a working width of said image-forming zone, a distance between at least one of said magnetized areas and said surface of said powder support member being less than 150 micrometers and a distance between said at least one magnetized area and said dielectric surface of said image-recording medium being less than 600 micrometers.

2. An image-forming device according to claim 1, wherein said gap comprises a width of from 0.5 to 20 times said distance between said at least one magnetized area from said surface of said image-recording medium.

3. An image-forming device according to claims 1 or 2 wherein said two oppositely magnetized areas consist of a ferromagnetic material having ends adjacent said gap, magnetized to saturation.

4. An image-forming device according to claim 3, wherein said ferromagnetic material is magnetized by magnetic contact with unlike poles of a permanent magnet.

* * * * *